US006276449B1

(12) United States Patent
Newman

(10) Patent No.: US 6,276,449 B1
(45) Date of Patent: Aug. 21, 2001

(54) ENGINE SPEED CONTROL FOR HOIST AND TONGS

(76) Inventor: Frederic M. Newman, 1618 W. Denger, Midland, TX (US) 79705

( * ) Notice: Subject to any disclaimer, the term of this patent is extended or adjusted under 35 U.S.C. 154(b) by 0 days.

(21) Appl. No.: 09/533,511

(22) Filed: Mar. 23, 2000

(51) Int. Cl.[7] ..... E21B 19/00

(52) U.S. Cl. ..... 166/53; 166/77.51; 254/328

(58) Field of Search ..... 180/69.3, 165; 166/53, 77.51, 77.1; 254/361, 328, 274, 275

(56) References Cited

U.S. PATENT DOCUMENTS 3,142,210 7/1964 Rodgers .
4,202,225 * 5/1980 Sheldon et al. ..... 81/57.35
4,418,931 12/1983 Howard .
4,640,245 * 2/1987 Matsuda et al. ..... 123/339
5,087,177 2/1992 Haley et al. .
5,335,487 * 8/1994 Murakawa et al. ..... 56/10.5
6,079,490 * 6/2000 Newman ..... 16/77.51
6,209,639 * 4/2001 Newman ..... 166/250.01

* cited by examiner

*Primary Examiner*—J. J. Swann
*Assistant Examiner*—J. Allen Shriver
(74) *Attorney, Agent, or Firm*—Robert J. Harter

(57) ABSTRACT

A mobile service rig for servicing an oil well includes a variable speed engine and a multi-speed transmission that selectively powers a drive wheel for transport, a hoist for lifting and lowering well-related components, and a hydraulic circuit for a tong used in tightening and loosening sucker rods or tubing. A speed adjuster operatively coupled to the engine limits the speed of the engine when the tong is operating, while a flow restriction limits the rate of hydraulic fluid flowing through the tong. Such an arrangement reduces power consumption, reduces heat, and avoids over tightening a sucker rod connection.

18 Claims, 1 Drawing Sheet

ENGINE SPEED CONTROL FOR HOIST AND TONGS

BACKGROUND OF THE INVENTION

1. Field of the Invention

The subject invention generally pertains to mobile service rigs for wells and more specifically to a mobile service rig that includes an engine powering a hoist and a tong.

2. Description of Related Art

Oil wells and wells for other fluids typically include a well casing, tubing, sucker rods and a reciprocating drive unit. A well casing is what lines the well bore and usually comprises a long string of relatively large diameter pipe interconnected by threaded couplings known as collars. Casings generally define the overall diameter and depth of a well bore. Well tubing typically comprises a long string of pipe sections whose threaded ends are also interconnected by threaded couplings. The tubing extends down through the casing and provides a conduit for conveying oil or some other fluid to the surface of the well. A submerged reciprocating pump attached to the lower end of the tubing draws the fluid from the annulus between the inside diameter of the casing and the outside diameter of the tubing, and forces the fluid up through the tubing to the surface. To operate the pump, a string of sucker rods extends through the tubing to serve as a long reciprocating connecting rod that couples the submerged pump to a reciprocating drive unit at ground level. A string of sucker rods typically includes numerous sucker rods whose ends are interconnected by a threaded rod coupling.

Servicing oil wells and other types of wells can involve a variety of tasks that include, but are not limited to, installing or removing sections of casing, sucker rods, tubing and pumps. The various tasks each have their own particular needs.

When working with sucker rods, a rod tong is often used for making-up and/or disassembling a string of rods. A typical rod tong is a hydraulically powered wrench that turns one sucker rod relative to an adjacent one so that one or the other screws into or unscrews from the rods' adjoining coupling. Since sucker rods are continuously subjected to a pulsating or reciprocating load, fatigue may cause a rod coupling to separate if the coupling had been over or under tightened when it was first installed. Thus, sucker rods should be tightened in a precise manner.

The assembly of tubing is less critical, as tubing is generally stationary in a well bore. To assembly or disassemble tubing, a tubing tong is often used, which also is a hydraulically powered wrench. Tubing tongs have serrated teeth that grip the outer wall of two adjacent tube sections, and then tighten the two sections into their mating coupling. The operation typically involves substantially more power than what is required when working with sucker rods, as the diameter of tubing is significantly larger than that of rods.

Removing or replacing sections of casing often involves heavy lifting by way of a hoist operating at fill capacity. Full-power lifting may be required when the casing is stuck and difficult to remove from the well bore, or may be required simply due to the casing being relatively heavy. The hoist is also needed, but at a much lower lifting capacity, when installing or removing sucker rods. For tubing or for setting a pump, the hoist is generally operated at some intermediate capacity between that used for casings and sucker rods.

Since there are numerous tasks involved in servicing a particular well, and various wells can be hundreds of miles apart, it would be advantageous to equip a single vehicle with the all equipment needed to perform the various tasks. It would be further advantageous to provide such a vehicle with a single engine or prime mover to power the various equipment. However, that can be difficult to do, as the power requirements vary broadly among the various operations.

For example, to power or propel such a vehicle down the highway or to operate its hoist at full capacity may require a 400 hp diesel engine, while tightening or loosening sucker rods may only require 10 hp. Tightening or loosening tubing may require 30 hp. Thus if a single hydraulic pump is used to power both tubing tongs and rod tongs, such a pump should be able to provide 30 hp for tubing even though only 10 hp would be needed for tongs. Likewise, a single diesel engine should be able to provide 400 hp for vehicular transport and heavy hoisting even though only 30 hp is needed to power the hydraulic pump. The resulting power imbalances of such a system create some serious problems, particularly when installing or removing sucker rods.

With sucker rods, the rod tong typically operates at something less than 30 hp, while the hoist operates at a relatively low capacity (e.g., low weight, fast speed) to quickly move the sucker rods into position. The rod tong can preferably tighten or loosen a sucker rod coupling within the time it takes the hoist to get another rod into position. Thus, the hoist and the rod tong work in concert in removing or installing a string of sucker rods. To keep such an operation moving smoothly, an operator preferably does not divide his attention between the operations of the hoist and speed of the diesel engine (which powers the hoist and the pump that powers the rod tong). Thus, the operator typically just runs the engine at full speed, with the hoist transmission in low gear to keep the hoist operating at a reasonable speed. This wastes fuel, may tend to shorten the life of the engine, and generates a tremendous amount of waste heat in the hydraulic system that drives the rod tong.

SUMMARY OF THE INVENTION

To conserve fuel and reduce heat generated by a rod tong hydraulic circuit, it is an object of the invention to limit the engine speed of a mobile service rig when installing or removing rod tongs.

Another object of the invention is to provide a mobile service rig for servicing wells that includes a common engine for powering a drive wheel, a hoist and a hydraulic circuit for a tong, such that the speed of the engine is reduced in response to feedback from the hydraulic circuit.

Another object is to provide a mobile service rig for servicing wells that includes a common engine for powering a drive wheel, a hoist and a hydraulic circuit for a tong, such that the hydraulic circuit includes a flow restriction whose flow coefficient increases with a decrease in a pressure differential applied across the restriction, whereby the flow rate of fluid through the hydraulic circuit does not vary proportionally with changes in the pressure differential.

Yet another object of the invention is to provide a mobile service rig with a hydraulic system that includes a common hydraulic pump to selectively drive a rod tong and a tubing tong, and provide such a system with an appropriate flow restriction.

A further object is to provide a mobile service rig with a single engine driving a single transmission, which in turn selectively powers both a hoist and a drive wheel, and provide such a rig with an appropriate speed adjuster for the engine.

These and other objects of the invention are provided by a mobile service rig that includes an engine and a transmission that selectively powers a drive wheel, a hoist and a hydraulic circuit for a tong. A speed adjuster operatively coupled to the engine unattendantly limits the speed of the engine when the tong is operating.

DESCRIPTION OF THE PREFERRED EMBODIMENT

Figure 1:
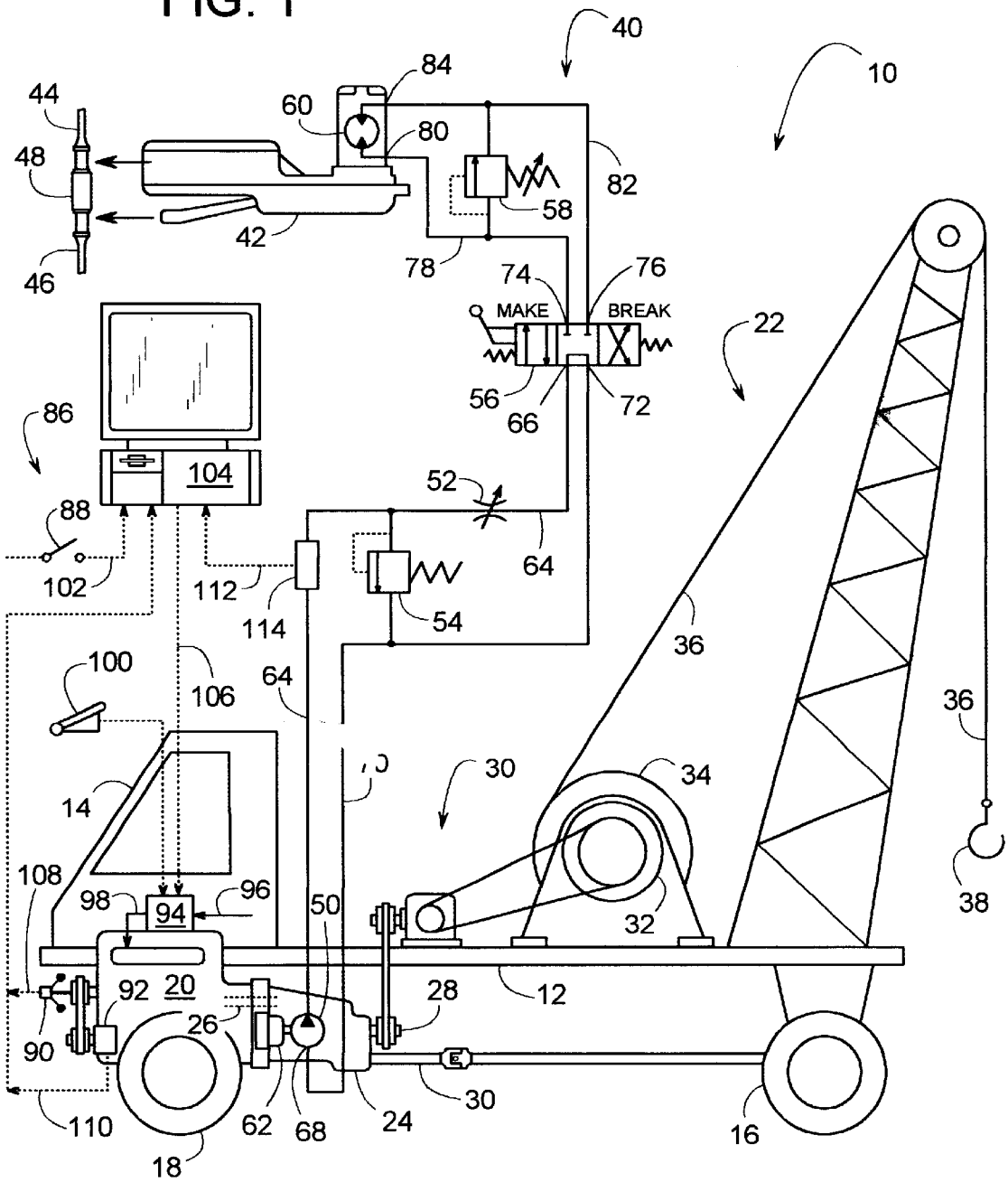
FIG. 1 is a schematic view of a mobile service rig according to at least one embodiment of the invention.

A service rig 10, of FIG. 1, includes a truck frame 12; an operator cab 14; at least one drive wheel 16; two front wheels 18; a diesel engine 20 (capable of about 400 hp); a hoist 22; and a transmission 24, such as a General Motors or Allison transmission that includes one input shaft 26, a first output shaft 28 and a second output shaft 30. Input shaft 26 is coupled to engine 20, second output shaft 30 is coupled to drive wheel 16 for propelling service rig 10 along the road, and first output shaft 28 is coupled to hoist 26 through a drive train 30 (e.g., gears, sprockets, chains, etc.). A clutch 32 selectively engages and disengages drive train 30 and a cable take-up reel 34 of hoist 22. The rotation of reel 34 determines the drawing in and paying out of a cable 36 for respectively raising and lowering of a hook 38. Service rig 10 also includes a hydraulic circuit 40 when connected to a tong 42, wherein the term, "tong" refers to a tool adapted to torque two sucker rods 44 and 46 that are connected by a threaded coupling 48.

Circuit 40 includes a hydraulic pump 50 (capable of about 30 hp), a flow restriction 52, a main pressure relief valve 54, a directional valve 56, a secondary pressure relief valve 58 and a hydraulic motor 60 of tong 42. An air actuated clutch 62 or dog clutch may couple hydraulic pump 50 to a flywheel or drive gear of transmission 24, or may couple pump 50 more directly to engine 20 (e.g., via the engine's harmonic balancer). A discharge line 64 from pump 50 delivers pressurized hydraulic fluid through flow restriction 52 and onto an inlet port 66 of valve 56. The hydraulic fluid returns to a suction port 68 of pump 50 by way of a return line 70, which is connected to an exhaust port 72 of valve 56. Valve 56 could comprise one or more valves in various configurations; however, in this example, valve 56 is a four-way, three-position spool valve that is manually actuated with a spring-return to a central neutral position.

In the neutral position, valve 56 connects discharge line 64 to return line 70 and closes off two valve ports 74 and 76. One hydraulic line 78 connects valve port 74 to a motor port 80 of motor 60, and second hydraulic line 82 connects valve port 76 to a second motor port 84. Manually actuating valve 56 in one direction connects discharge line 64 and return line 70 to lines 78 and 82 respectively, which drives motor 60 in a direction that tightens or "makes" a sucker rod connection. Actuating valve 56 in the opposite direction connects discharge line 64 and return line 70 to lines 82 and 78 respectively, which reverses the rotation of motor 60 for unscrewing or "breaking" a sucker rod connection.

When making a connection, secondary pressure relief valve 58 limits the pressure that can be applied across motor 60, thus helping to limit the extent to which a connection can be tightened. Relief 58 is preferably adjustable to suit sucker rods of various diameter. The main pressure relief valve 54 serves to limit the overall pressure that can be applied to hydraulic circuit 40. Typical pressure relief settings of relief valves 58 and 54 might be 800 psig and 2,000 psig, respectively.

In some instances, hydraulic fluid at an appropriate pressure, but at an excessively high volume or flow rate, may allow tong 42 to accelerate to an exceptionally high speed before a sucker rod connection reaches what is known as its shoulder point. The shoulder point is where an axial face of a rod comes into metal-to-metal contact with a mating axial face of a coupling. In other words, the shoulder point is where the connection just begins tightening into a strained preloaded condition. If tong 42 is running excessively fast upon reaching the shoulder point, the rotational momentum of tong 42 plus the rotational momentum of a rotating sucker rod may provide enough kinetic energy to over tighten the connection, regardless of what pressure relief valve 58 opens. This is especially likely to occur if engine 20 is driving pump 50 at full speed; however, the problem may also occur at lower speeds.

Thus, flow restriction 52 is used to limit the volume or flow rate of hydraulic fluid passing through discharge line 64. Ideally, restriction 52 would provide a constant flow rate (e.g. 14 gpm), regardless of how fast engine 20 is driving pump 50. However, one economical solution to the problem is achieved by selecting a flow restriction whose flow coefficient increases with a decrease in a pressure differential applied across the restriction. An example of such a flow restriction is a model NS1600 COLORFLOW needle valve, by Parker Hannifin Corporation, of Elyrie, Ohio. The term, "flow coefficient" is defined as a ratio of the fluid flow to the pressure differential (e.g., gpm divided by psig). For example, when engine 20 is operating at 2,500 rpm, flow restriction 52 might convey 14 gpm, and when engine 20 slows down to 1,250 rpm (half of its original speed), the flow of hydraulic fluid might only drop 2 gpm to convey 12 gpm. Thus, the flow through restriction 52 might only change slightly with drastic changes in engine speed.

This allows engine 20 to run at full speed without delivering an excessive rate of flow to tong 42, and also allows the speed of engine 20 to be reduced to a speed that more closely matches the relatively low power requirements of tong 42. Reducing the speed of engine 20 lowers the pressure in discharge line 64 to a level below the pressure at which main relief valve 54 opens. In contrast, if relief valve 54 were to open to relieve pressure exceeding its set limit, a significant amount of heat could be generated at relief valve 54. For example, if pressure relief valve 54 had to open to limit the pressure in discharge line 64 to 2,000 psig, and doing so allowed valve 54 to convey 10 gpm from discharge line 64 at 2,000 psig to return line 70 at zero psig, then about 30,000 Btu/hr (comparable to 11.6 hp) of waste heat is generated at valve 54. Thus, it may be beneficial to reduce the speed of engine 20 so that pump 50 has a discharge pressure that is less than the pressure at which main relief valve 54 opens.

This can be accomplished by providing service rig 10 with a speed adjuster 86, i.e., a device that selectively determines whether engine 20 operates at a lower speed mode or a higher speed mode. A lower speed mode can be a first range of speeds and the higher speed mode can be a second range of speeds, with the average of the first range being lower than that of the second range. Some overlap of the two ranges is possible.

Perhaps the simplest form of a speed adjuster is a switch 88, which is schematically illustrated to encompass a variety of switches including, but not limited to, mechanical mechanisms (e.g. a governor 90 driven by engine 20), pneumatic mechanisms (e.g., diaphragms, vacuum lines, pneumatic valves, etc.), electrical mechanisms, electromechanical mechanisms (e.g., an engine driven alternator 92 that serves as one example of a tachometer by providing an output voltage or frequency that varies with engine speed), manually actuated electrical switches, electromechanically actuated switches (e.g., solenoid actuated relay), solid state switches (e.g., transistor, triac, diac, computer, programmable logic controller, etc.), transducers, sensor actuated switches (pressure sensor, flow sensor, temperature sensor, etc.), vehicle cruise control mechanisms, and "soft switches," such as those of a touch screen monitor. Switch 88, in some embodiments, simply acts directly or indirectly upon a fuel injector 94 to regulate or simply restrict incoming fuel 96 to supply a desired limited rate of supply fuel 98 to engine 20. For example, closing switch 88 could limit incoming fuel 96 to provide an average engine speed of 1,250 rpm. Opening switch 88, as shown in FIG. 1, could simply disable itself to allow engine 20 to be controlled in the usual manner of a conventional accelerator pedal 100, or could allow a full rate of supply fuel 98 to provide an average engine speed of 2,500 rpm. Switch 88 preferably has maintained open and closed positions to allow engine 20 to operate at either of its higher or lower speed modes without ongoing operator attention. In other words, switch 88 is preferably adapted to unattendantly maintain engine 20 at its lower or higher speed modes.

In some embodiments, switch 88 provides an input signal 102 to a control 104 (e.g., a computer), which in response thereto provides an output 106 that determines the speed mode of engine 20 Examples of input signal 102 includes, but is not limited to, feedback 108 from governor 90, feedback 110 from alternator 92, and feedback 112 from a sensor 114. Sensor 114 is schematically illustrated to encompass various sensors including, but not limited to a fluid pressure sensor that senses the pressure in discharge line 64, a temperature sensor that senses some predetermined temperature associated with hydraulic circuit 40, and a fluid flow sensor that senses the flow rate of hydraulic fluid passing through hydraulic circuit 40.

In some embodiments, sensor 114 is a flow sensor, and feedback signal 112 represents the rate of hydraulic fluid flowing through discharge line 64. Control 104 then adjusts output 106 so that engine 20 drives pump 68 at a speed that produces a predetermined flow rate of hydraulic fluid, such as 14 gpm. In other embodiments, sensor 114 is a pressure sensor, and feedback signal 112 represents the pressure in discharge line 64. Control 104 then adjusts output 106 so that engine 20 drives pump 50 at a speed that produces a predetermined pressure in discharge line 64, such as 1,950 psig or some other predetermined pressure just below the pressure at which main relief valve 54 is set to open, thereby ensuring valve 54 normally remains closed.

Transmission 24 has multiple speed positions to selectively provide at least a low-gear operation and a high-gear operation, wherein the ratio of speed of first output shaft 28 to input shaft 26 is higher in the high-gear operation than in the low-gear operation for operating hoist 22 at various speeds. High-gear operation can be used for light, rapid hoisting, and low-gear can be used for heavy lifting. Likewise, the ratio of speed of second output shaft 30 to input shaft 26 is higher in the high-gear operation than in the low-gear operation when mobile service rig 10 is traveling down a road. Thus, operating transmission 24 in high-gear and running engine 20 in its lower speed mode renders rig 10 operable in a reduced power mode that is suitable for normal tong operations and rapid light hoisting of sucker rods. Operating engine 20 in its higher speed mode renders rig 10 operable in a higher power mode that is suitable for heavy lifting; however, the higher power mode is also suitable for tong operations if desired. Shifting transmission 24 among its various speed positions can be carried out by conventional linkage and clutch arrangements that are well know to those skilled in the art.

Although the invention is described with reference to a preferred embodiment, it should be appreciated by those skilled in the art that various modifications are well within the scope of the invention. Therefore, the scope of the invention is to be determined by reference to the claims that follow.

I claim:

1. A mobile service rig for servicing a well, comprising:

a drive wheel adapted to propel said mobile service rig;

a hoist;

a pump;

a motor driven by said pump;

a tong driven by said motor;

an engine being operatively coupleable to said drive wheel, said hoist, and said pump, said engine having a lower speed mode and a higher speed mode when operatively coupled to said hoist and said pump, wherein said engine operates within a first speed range in said lower speed mode and operates within a second speed range in said higher speed mode with a first average speed of said first speed range being lower than a second average speed of said second speed range; and a speed adjuster operatively coupled to said engine, said speed adjuster being adapted to selectively determine said lower speed mode and said higher speed mode, said speed adjuster being further adapted to unattendantly maintain said engine selectively at said lower speed mode and said higher speed mode.

2. The mobile service rig of claim 1, further comprising a flow restriction in fluid communication with said pump and said motor, said flow restriction being adapted to convey a fluid flow therethrough, said flow restriction having a flow coefficient that increases with a decrease in a pressure differential applied thereacross, wherein said flow coefficient is defined as a ratio of said fluid flow to said pressure differential.

3. The mobile service rig of claim 1, further comprising a transmission that includes an input shaft, a first output shaft and a second output shaft, wherein said first input shaft is coupled to said engine, said first output shaft is coupled to said hoist and said second output shaft is coupled to said drive wheel.

4. The mobile service rig of claim 1, further comprising a pressure relief valve in fluid communication with said pump, said pressure relief valve being more open when said engine is at said higher speed mode than when said engine is as said lower speed mode.

5. The mobile service rig of claim 1, wherein said speed adjustor includes a switch that triggers said engine to switch between said lower speed mode and said higher speed mode.

6. The mobile service rig of claim 1, wherein said speed adjuster affects a rate of fuel flow to said engine to selectively determine said lower speed mode and said higher speed mode.

7. The mobile service rig of claim 1, wherein said speed adjuster includes a tachometer that senses a variable that varies with the rotational speed of said engine, wherein said speed adjuster limits said rotational speed of said engine in response to said tachometer.

8. The mobile service rig of claim 7, wherein said tachometer includes a mechanical governor.

9. The mobile service rig of claim 7, wherein said tachometer includes an alternator, and said variable comprises at least one of a voltage and a frequency.

10. The mobile service rig of claim 1, further comprising a relief valve in fluid communication with said motor, said relief valve being substantially closed when said engine is in said lower speed mode and being open when said engine is at said higher speed mode.

11. The mobile service rig of claim 1, wherein said speed adjuster includes a fluid sensor in fluid communication with said pump.

12. The mobile service rig of claim 11, wherein said fluid sensor is a pressure transducer that provides a signal that varies with pressure.

13. The mobile service rig of claim 11, wherein said fluid sensor is a flow transducer that provides a signal that varies with a rate of fluid flow.

14. A mobile service rig for servicing a well, comprising:

an engine having a lower speed mode and a higher speed mode wherein said engine operates within a first speed range in said lower speed mode and operates within a second speed range in said higher speed mode with a first average speed of said first speed range being lower than a second average speed of said second speed range;

a transmission that includes an input shaft, a first output shaft and a second output shaft with said input shaft being coupled to said engine, said transmission having a low-gear operation and a high-gear operation, wherein a ratio of speed of said first output shaft to said input shaft is greater in said high-gear operation than in said low-gear operation;

a hoist coupled to said first output shaft;

a hydraulic pump coupleable to said engine;

a hydraulic motor hydraulically coupled to said hydraulic pump;

a tong driven by said hydraulic motor;

a drive wheel adapted to propel said mobile service rig and being coupled to said second output shaft; and a flow restriction in fluid communication with said hydraulic pump and said hydraulic motor, said flow restriction being adapted to convey a fluid flow therethrough, said flow restriction having a flow coefficient that increases with a decrease in a pressure differential applied thereacross, wherein said flow coefficient is defined as a ratio of said fluid flow to said pressure differential.

15. The mobile service rig of claim 14, further comprising a speed adjuster operatively coupled to said engine and being adapted to selectively determine said lower speed mode and said higher speed mode; wherein said engine in said lower speed mode and said transmission in said high-gear operation renders said mobile service rig operable in a reduced power mode suitable for normal tong operation and relatively light hoisting; and wherein said engine in said higher speed mode renders said mobile service rig operable in a higher power mode suitable for normal tong operation and relatively heavy hoisting.

16. The mobile service rig of claim 14, further comprising a pressure relief valve in fluid communication with said hydraulic pump, said pressure relief valve being more open when said engine is at said higher speed mode than when said engine is as said lower speed mode.

17. The mobile service rig of claim 15, wherein said speed adjuster includes a fluid sensor in fluid communication with said pump.

18. A mobile service rig for servicing a well, comprising:

an engine having a lower speed mode and a higher speed mode wherein said engine operates within a first speed range in said lower speed mode and operates within a second speed range in said higher speed mode with a first average speed of said first speed range being lower than a second average speed of said second speed range;

a transmission that includes an input shaft, a first output shaft and a second output shaft with said input shaft being coupled to said engine, said transmission having a low-gear operation and a high-gear operation, wherein a ratio of speed of said first output shaft to said input shaft is greater in said high-gear operation than in said low-gear operation;

a hoist coupled to said first output shaft;

a hydraulic pump coupleable to said engine;

a hydraulic motor hydraulically coupled to said hydraulic pump;

a tong driven by said hydraulic motor;

a drive wheel adapted to propel said mobile service rig and being coupled to said second output shaft;

a flow restriction in fluid communication with said hydraulic pump and said hydraulic motor, said flow restriction being adapted to convey a fluid flow therethrough, said flow restriction having a flow coefficient that increases with a decrease in a pressure differential applied thereacross, wherein said flow coefficient is defined as a ratio of said fluid flow to said pressure differential;

a pressure relief valve in fluid communication with said hydraulic pump, said pressure relief valve being more open when said engine is at said higher speed mode than when said engine is as said lower speed mode; and a speed adjuster operatively coupled to said engine and being adapted to selectively determine said lower speed mode and said higher speed mode; wherein said engine in said lower speed mode and said transmission in said high-gear operation renders said mobile service rig operable in a reduced power mode suitable for normal tong operation and relatively light hoisting; and wherein said engine in said higher speed mode renders said mobile service rig operable in a higher power mode suitable for normal tong operation and relatively heavy hoisting.

* * * * *